US006038726A

United States Patent [19]

Kelly et al.

[11] Patent Number: 6,038,726

[45] Date of Patent: Mar. 21, 2000

[54] FLOOR WIPER CONSTRUCTION

[76] Inventors: Thomas J. Kelly; Trucee V. Kelly, both of 5308 Millington Rd., Clayton, Del. 19938

[21] Appl. No.: 09/113,604

[22] Filed: Jul. 10, 1998

[51] Int. Cl.[7] ..... A47L 13/282

[52] U.S. Cl. ..... 15/227; 36/113; 36/59 R

[58] Field of Search ..... 15/227; 36/62, 36/59 R, 7.1 R, 8.1, 7.6, 9 R, 11, 10, 113

[56] References Cited

U.S. PATENT DOCUMENTS

| | | |
|---|---|---|
| 1,136,150 | 4/1915 | McGrath . |
| 2,571,606 | 10/1951 | Peterson . |
| 2,738,533 | 3/1956 | Peterson . |
| 3,015,170 | 1/1962 | Kramer . |
| 3,526,014 | 9/1970 | Edwards . |
| 3,526,917 | 9/1970 | Haywood, Jr. . |
| 3,680,170 | 8/1972 | Sims . |
| 3,699,672 | 10/1972 | Sims . |
| 4,541,185 | 9/1985 | Chou . |
| 5,173,985 | 12/1992 | Palmer . |
| 5,613,897 | 3/1997 | Thompson, Jr. . |
| 5,644,813 | 7/1997 | Puskas . |

FOREIGN PATENT DOCUMENTS

| | | |
|---|---|---|
| 25382 | 3/1902 | Switzerland . |
| 9005478 | 2/1989 | WIPO . |

*Primary Examiner*—Robert J. Warden, Sr.
*Assistant Examiner*—Jennifer C. McNeil
*Attorney, Agent, or Firm*—Henderson & Sturm LLP

[57] ABSTRACT

A floor wiper construction 10 for cleaning a floor surface and including a slipper member 20 having a sole portion 22 provided with compressible cleaning material 31 and a plurality of friction members 40 which will project through the compressible clearing material 31 when the user places their weight on the slipper member 20 to prevent the user's foot from sliding on the floor surface.

2 Claims, 1 Drawing Sheet

FLOOR WIPER CONSTRUCTION

BACKGROUND OF THE INVENTION

1. Field of the Invention

The present invention relates to the field of foot worn wiping devices in general, and in particular to such a device having a positive traction means.

2. Description of Related Art

As can be seen by reference to the following U.S. Pat. Nos. 3,680,170; 3,699,672; 5,173,985; and 5,613,897, the prior art is replete with myriad and diverse foot worn floor wiping or cleaning devices.

While all of the aforementioned prior art constructions are more than adequate for the basic purpose and function for which they have been specifically designed, they are uniformly deficient with respect to their failure to provide a simple, efficient, and practical way to provide a floor wiping device having both a large cleaning surface and a positive traction means so that the user will not slip on the floor surface.

As shown in the prior art devices, to date only small surface area foot worn cleaning devices have been developed due to the very real danger of the user slipping on the floor surface if larger surface area cleaning elements were employed.

As a consequence of the foregoing situation, there has existed a longstanding need for a new and improved floor wiping construction which will incorporate positive traction elements into a large surface area wiper member to provide a safe footing for the user, and the provision of such a construction is a stated objective of the present invention.

BRIEF SUMMARY OF THE INVENTION

Briefly stated, the floor wiper construction that forms the basis of the present invention comprises a slipper unit, a wiper unit, and a friction gripping unit wherein the wiper unit and the friction gripping unit are disposed on the bottom of the slipper unit.

As will be explained in greater detail further on in the specification, the slipper unit comprises a slipper member having a sole portion wherein the wiper unit and the friction gripping unit depend downwardly from the sole portion of the slipper member.

In addition, the wiper unit includes a wiper member comprising compressible cleaning material such as mop strands or the like, wherein the friction gripping unit comprises a plurality of friction gripping members dispersed throughout the cleaning material so that when the user places their weight on the foot bearing the floor wiping construction the cleaning material will be compressed to engage the friction gripping members with the floor surface.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
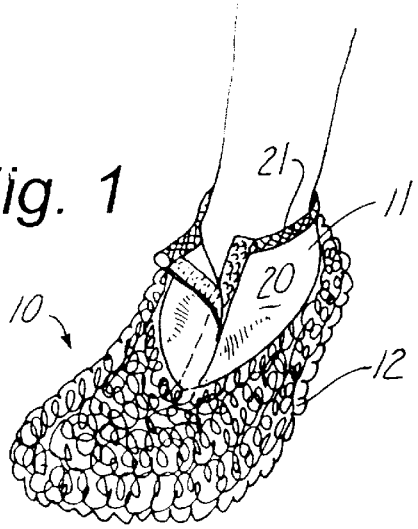
FIG. 1 is a top perspective view of the floor wiping construction.
Figure 2:
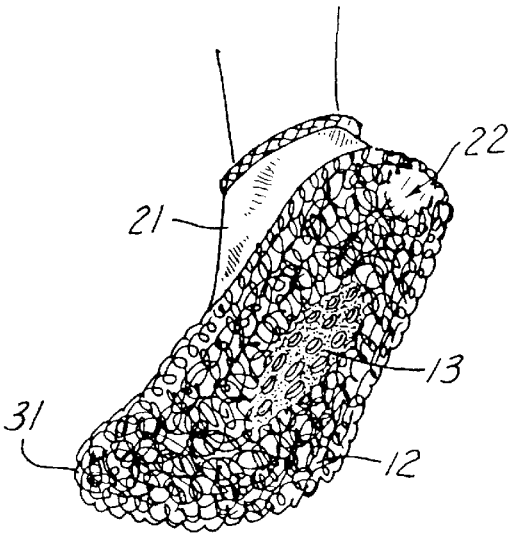
FIG. 2 is a bottom perspective view of the floor wiping construction.

As can be seen by reference to the drawings, and in particularly to FIGS. 1 and 2, the floor wiper construction that forms the basis of the present invention is designated generally by the reference number 10. The construction 10 comprises in general, a slipper unit 11, a wiper unit 12, and a friction gripping unit 13. These units will now be descried in seriatim fashion.

Figure 4:
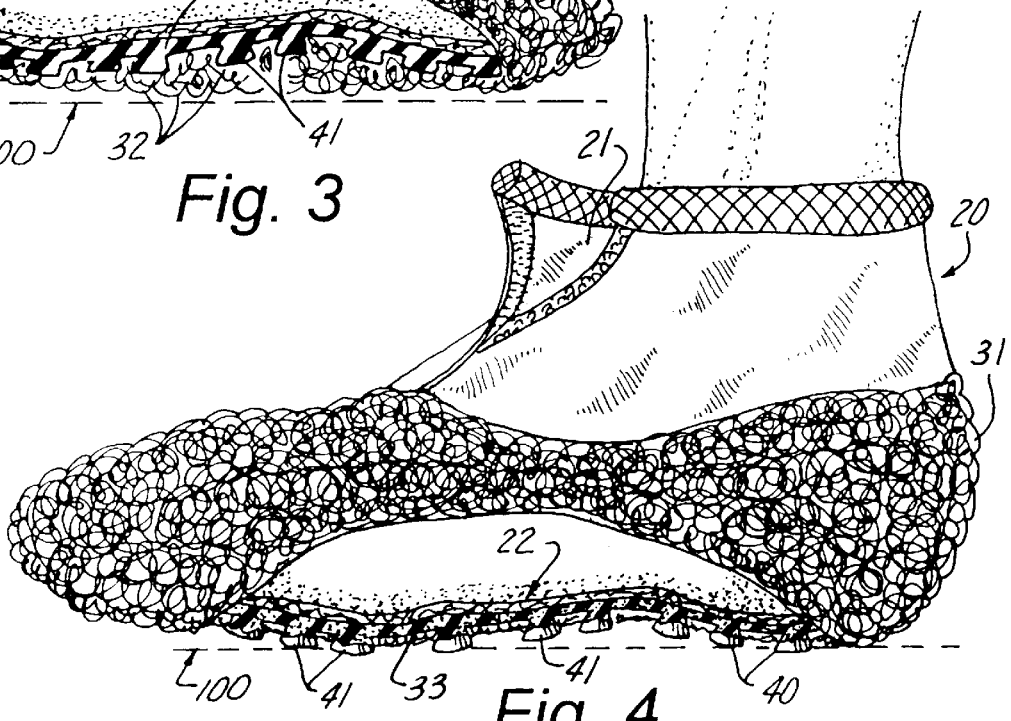
FIG. 4 is a partial cut away view of the construction with the friction gripping unit engaging a floor surface.

As shown in FIG. 4, the slipper unit 11 comprises a slipper member 20 dimensioned to engage a user's foot and having an elasticized opening 21 and a sole portion 22. The sole portion 22 is equipped with both the wiper unit 12 and the friction gripping unit 13.

As can be seen by reference to FIGS. 1 through 4, the wiper unit 12 comprises a wiper member 30 including compressible cleaning material 31 such as a plurality of looped mop strands 32 of yarn or the like, which are affixed to and depend downwardly from the bottom of the sole portion 22 of the slipper member 20.

It should further be noted at this juncture that even though the wiper unit 12 of the preferred embodiment of this invention calls for a mop strands 32, it is to be understood that in keeping with the teachings of this invention, a sponge 33 may be substituted therefor since the basic purpose of the wiper unit 12 is to wipe clean and/or polish a floor surface.

Figure 3:
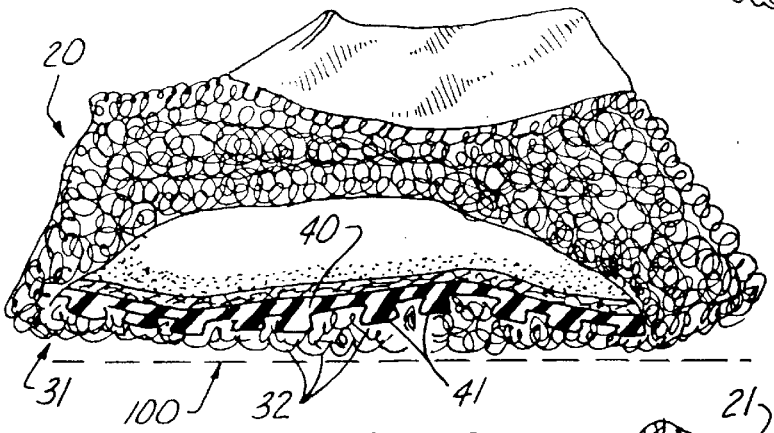
FIG. 3 is a partial cut away view of the construction in wiping contact with a floor surface.

Furthermore, as shown in FIGS. 3 and 4, the friction gripping unit 13 comprises a plurality of high coefficient of friction members 40 such as cleat elements 41 fabricated from hard rubber or the like which are affixed to and depend downwardly from the bottom of the sole portion 22 of the slipper member 20.

In addition, as can best be appreciated by reference to FIG. 4, the cleat elements 40, 41 are disposed at spaced locations on the sole portion 22 of the slipper member 20 and the length of each cleat element 40, 41 is substantially less than the effective length of each of the looped strands 31 of the mop member 30 in order that the wiper unit 12 can function in its intended manner as the user sweeps the mop unit 12 across the floor surface 100 in the conventional fashion.

However, as was mentioned previously, when the user applies sufficient downward pressure on the foot bearing the construction 10, the wiper unit 12 will be compressed bringing the friction members 40 into contact with the floor surface to provide positive traction to the user's foot.

In this manner, the user can sweep the floor wiper construction 10 back and forth on the surface of the floor in the normal fashion. When the user moves in any direction to continue wiping the floor surface 100 their weight will cause the friction members 40 to grip the floor surface 100 so that the user will not slip thereon.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A floor wiper construction for cleaning the surface of a floor wherein the wiper construction comprises:

a slipper unit including a slipper member dimensioned to engage a user's foot and provided with a sole portion;

a wiper unit including compressible cleaning material affixed to and depending downwardly from the sole portion of the slipper member; wherein the compressible cleaning material comprises a plurality of looped mop strands; and a friction gripping unit including a plurality of friction members affixed to and depending downwardly from the sole portion of the slipper member, wherein an uncompressed length of the compressible cleaning material is longer than the length of said friction members, and a compressed length of the compressible cleaning material is equal to the length of the friction members, and wherein the plurality of friction members comprise cleat elements disposed at spaced locations on the sole portion of the slipper member.

2. A floor wiper construction for cleaning the surface of a floor wherein the wiper construction comprises:

a slipper unit including a slipper member dimensioned to engage a user's foot and provided with a sole portion;

a wiper unit including compressible cleaning material affixed to and depending downwardly from the sole portion of the slipper member; wherein the compressible cleaning material comprises a sponge; and a friction gripping unit including a plurality of friction members affixed to and depending downwardly from the sole portion of the slipper member, wherein an uncompressed length of the compressible cleaning material is longer than the length of said friction members, and a compressed length of the compressible cleaning material is equal to the length of the friction members, and wherein the plurality of friction members comprise cleat elements disposed at spaced locations on the sole portion of the slipper member.

* * * * *